United States Patent [19]

Teubler et al.

[11] Patent Number: 4,637,782

[45] Date of Patent: Jan. 20, 1987

[54] ROTARY VANE PUMP

[75] Inventors: Heinz Teubler, Friedrichsdorf; Rene Schulz, Neu-Anspach, both of Fed. Rep. of Germany

[73] Assignee: Vickers Systems GmbH, Bad Homburg, Fed. Rep. of Germany

[21] Appl. No.: 830,254

[22] Filed: Feb. 18, 1986

Related U.S. Application Data

[63] Continuation of Ser. No. 696,268, Jan. 30, 1985, abandoned.

[30] Foreign Application Priority Data

Feb. 4, 1984 [EP] European Pat. Off. ..... 84101136.4

[51] Int. Cl.[4] ..... F04B 49/02

[52] U.S. Cl. ..... 417/300; 417/310

[58] Field of Search ..... 417/310, 307, 300

[56] References Cited

U.S. PATENT DOCUMENTS 3,384,020 5/1968 Searle ..... 417/300

4,199,304 4/1980 Strikis et al. ..... 417/310

4,470,768 9/1984 Konz ..... 417/310

FOREIGN PATENT DOCUMENTS 1528973 9/1969 Fed. Rep. of Germany ..... 417/310

*Primary Examiner*—John J. Vrablik

*Attorney, Agent, or Firm*—Barnes, Kisselle, Raisch, Choate, Whittemore & Hulbert

[57] ABSTRACT

A hydraulic rotary vane pump comprises a flow control valve with a venturi throat disposed upstream thereof whereby the entire delivery flow from the pump passes through the venturi throat. The flow control valve is operable to control the amount of fluid flowing to the delivery outlet of the unit, under the influence of the pressure drop at a restrictor throttle in the form of a bore extending from the throat transversely with respect to the axis thereof. The angle between the axis of the venturi throat and the axis of the bore is between 90° and 150° depending on the degree to which the characteristic of the outlet flow produced is intended to drop off.

7 Claims, 5 Drawing Figures

ROTARY VANE PUMP

This application is a continuation of application Ser. No. 696,268, filed Jan. 30, 1985, now abandoned.

BACKGROUND OF THE INVENTION

The present invention relates generally to a pump and more particularly to a rotary vane pump, more specifically a pump for steering assistance.

A known rotary vane pump as disclosed for example in German specification No. DE-A-1 528 973 has two displacement regions for displacing the fluid to be pumped, with an inlet opening and an outlet opening, the inlet opening being connected to a hydraulic fluid supply system and the outlet opening being connected to a hydraulic fluid discharge system. The supply and discharge systems communicate with each other by way of a flow control valve for by-passing an excess portion of the displaced flow of the pump into the supply system, the flow control valve including a spool with two spool areas acted upon by respective pressures, a valve spring and an orifice means at which a pressure drop of the controlled output flow of the pump is taken off and passed to the two areas of the spool. The discharge system of the pump has an annular chamber to which there is connected a passage having two passage portions branching therefrom, the directions of flow therein being turned through 90° in each passage. A throat is disposed in the first branch passage orifice and carries the entire displaced flow of the pump. The orifice is disposed in the second branch portion. The design options in regard to the arrangement of the throat and the orifice are limited because of the geometrical factors in the design of the pump. Thus, in that pump, the throat is not arranged coaxially with respect to the spool. The desired output flow is shown to increase slightly in relation to an increasing speed of rotation of the pump.

In another rotary vane pump of the general kind just described above, as disclosed in German specification DE-A-2,001,614, the flow control valve has a first and a second restrictor means in the hydraulic fluid discharge system disposed in succession, for delivering a pressure drop to the flow control valve to permit the achievement of a falling characteristic in respect of the output flow from the pump, in relation to the speed of rotation thereof. With a steering assistance pump of ZF type 7681 produced according to the principles of the just mentioned patent, however, that falling characteristics is only achieved in relation to a pressure range of from 0 to 10 bars. The pump has two displacement regions which respectively communicate with the fluid discharge system by way of outlet openings in the pressure plate of the pump, while disposed upstream of one of the outlet openings is a plug-like throttle insert member as the first restrictor means and which includes an orifice bore as the second restrictor means through which the controlled output flow of the pump is taken off. A disadvantage with that construction is a certain degree of randomness in the flow around the throttle insert member as it is not possible for all the displaced flow to be effective for the restrictor means and therefore for the flow control valve.

In another known rotary vane pump, as disclosed in U.S. Pat. No. 4,199,304, the output flow of the pump to the load connected thereto flows through a restrictor in the form of a venturi throat, the pressure drop of which thus depends on the output flow. The pressure drop produced in that way is passed to the spool by way of a transverse bore and a passage means, so that the spool is moved at a higher level of output flow, to a greater degree than at a lower level of output flow. Accordingly, as the spool is moved to a greater degree, the flow of hydraulic fluid into the inlet of the pump is shut down to a progressively increasing extent and the output flow cannot increase to the degree as would otherwise occur by virtue of the higher speed of rotation of the hydraulic pump. Therefore, the degree to which the output flow increases is reduced, with a given increase in pump speed, whereby the output flow remains relatively constant at higher pump speeds, even if the speed of roation of the pump increases further.

In a situation involving steering assistance, the output flow is returned to the tank by way of the steering valve. When that occurs, the hydraulic fluid which is under pressure, is relieved, which results in a corresponding energy loss if the steering system does not absorb and make use of the power provided thereby. In practical circumstances, such a high level of power utilisation does not occur in the range of high speeds of rotation of the pump, because it is not possible to make sharp steering motions when travelling quickly. Accordingly, in the high range of pump rotation, the system maintains a condition of constant power output readiness which is not required at that level and which thus results in an unnecessary energy loss.

SUMMARY OF THE INVENTION

An object of the present invention is to provide a rotary vane pump which is so designed as to influence the magnitude of the output flow, in dependence on the range of speed of pump rotation, in regard to achieving a desired pump output characteristic.

Another object of the present invention is to provide a rotary vane pump wherein the output flow therefrom is reduced at higher speeds of pump rotation.

Still another object of the present invention is to provide for more sensitive control of the pump output in relation to varying speeds of pump rotation.

These and other objects are achieved by means of a rotary vane pump comprising a housing with a vane-carrying rotor rotatable therein, defining at least one displacement region communicating with inlet port means and outlet port means. The inlet port means of the or each displacement region communicate with a hydraulic fluid supply system while the outlet port means communicate with a hydraulic fluid discharge system. The discharge and supply systems communicate by way of a flow control valve which discharges or by-passes an excess portion of the pump delivery flow into the supply system, the flow control valve including a housing defining a bore in which a spool is axially movable, the spool having first and second areas to which respective pressures are applied, a valve spring biasing a spool, and an orifice means at which a pressure drop in a controlled output flow of the pump is taken off and supplied to the two surfaces of the spool, while disposed upstream of the orifice means is a throat which carries the entire displacement flow of the pump. The throat is in the form of a venturi throat and the orifice means is in the form of a bore which branches off said venturi throat transversely with respect thereto.

Thus, the pump according to the principles of the present invention comprises a casing having a chamber or cavity formed therein, with a fluid supply system including an inlet port in the casing and inlet openings communicating with the cavity, as well as a fluid discharge system including outlet openings from the cavity and an outlet port in the casing. Disposed in the casing are displacement means adapted to displace fluid from the supply system into the discharge system, to produce a displacement or delivery flow. Disposed between the fluid supply and discharge systems is a flow control valve which is operable to by-pass fluid from the discharge system into the supply system so as to leave a desired flow within the discharge system, between the flow control valve and the outlet port. The flow control valve comprises a housing having passage means therein including an orifice, a spool having a first pressure surface for opening of said by-pass and a second pressure surface for closing said by-pass, and a valve spring biasing the spool into the by-pass closing position. The orifice has an upstream side and a downstream side, the upstream side being connected to the first pressure surface of the spool and the downstream side being connected to the second pressure surface of the spool. A throat in the form of a venturi throat is included in the fluid discharge system and has walls such as to receive all the displacement or delivery flow of the pump, with the orifice being formed as an opening in the walls of the venturi throat, extending substantially transversely with respect thereto, thereby to conduct the above-mentioned desired flow to the outlet port.

Thus, the entire displaced flow of the pump, which rises in proportion to the speed of rotation of the pump, is conducted through the venturi throat and is there divided into the output flow which flows through the orifice means, and the by-passed excess flow portion which passes into the pump supply system. If the by-passed excess flow portion is substantially greater at higher speeds of pump rotation than the controlled output flow from the pump, the pressure at the narrowest location in the venturi throat drops to an increasing degree and therewith also the pressure in the control chamber of the flow control valve. As a result, the flow control valve is opened to a comparatively greater degree and the by-passed flow portion increases to a greater extent than corresponds to the increase in the pump delivery flow as a result of the increase in the speed of pump rotation. Due to the controlled output flow of the pump also being reduced with an increasing speed of pump rotation, the dynamic pressure in the steering system valve is also reduced so that the energy loss of the system is reduced in comparison with the above-discussed prior-art pumps, both because of the reduced flow and also because of the reduced pressure loss.

Further objects, features and advantages of the present invention will be more clearly apparent from the following description of a preferred embodiment of a pump in accordance with the invention.

DESCRIPTION OF THE PREFERRED EMBODIMENT

Figure 1:
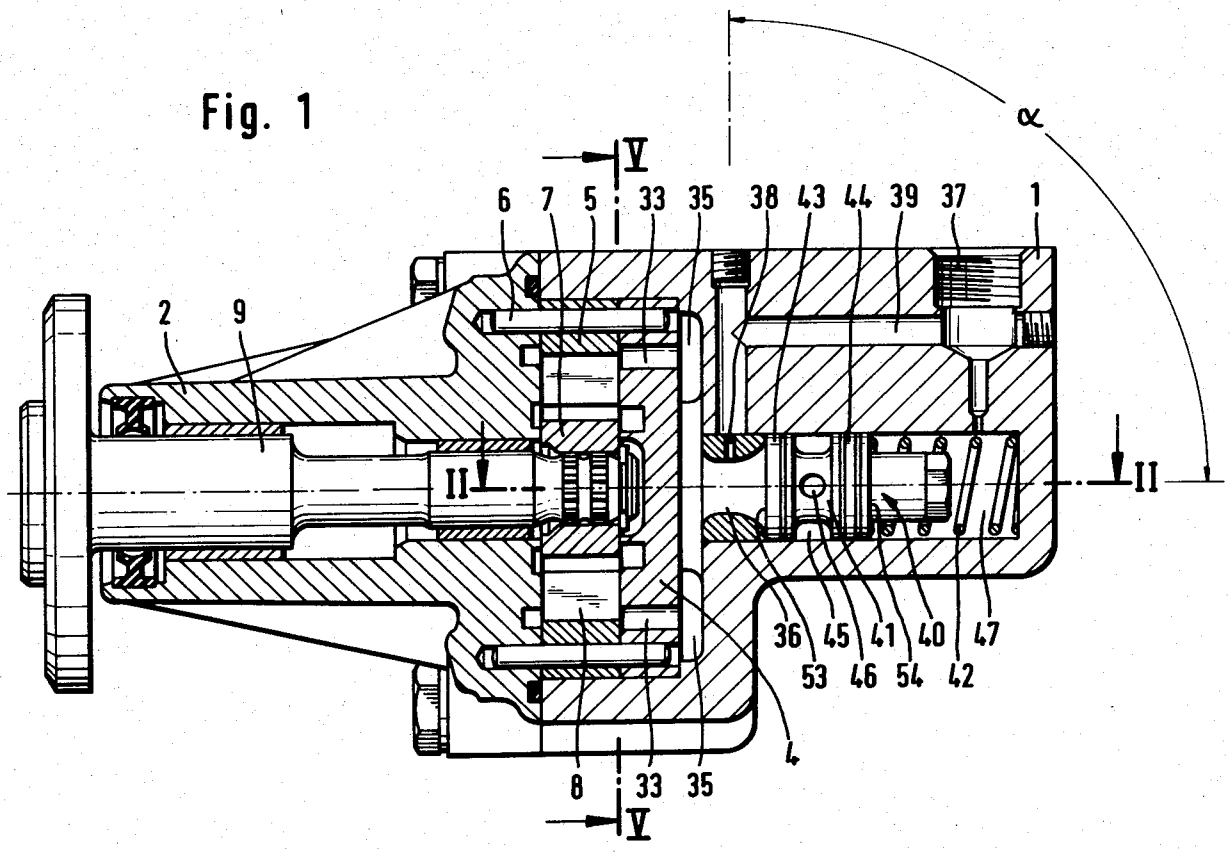
FIG. 1 shows a view in vertical longitudinal section through a rotary vane pump according to the invention.
Figure 2:
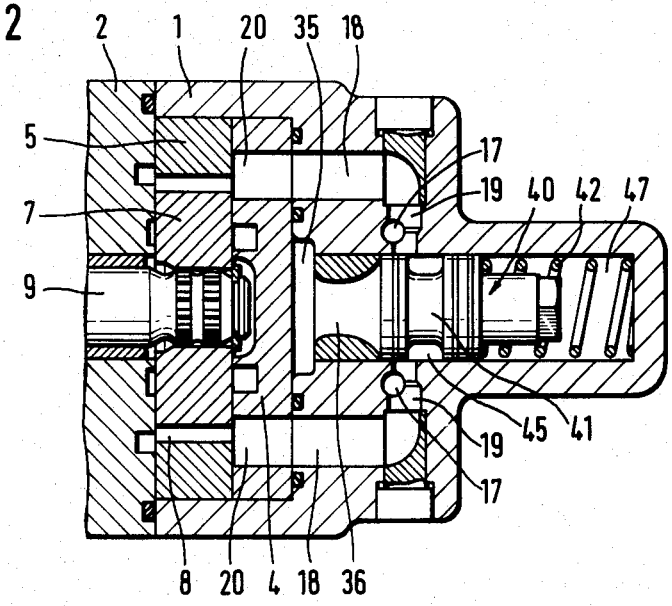
FIG. 2 shows a horizontal longitudinal section taken along line II—II in FIG. 1.
Figure 5:
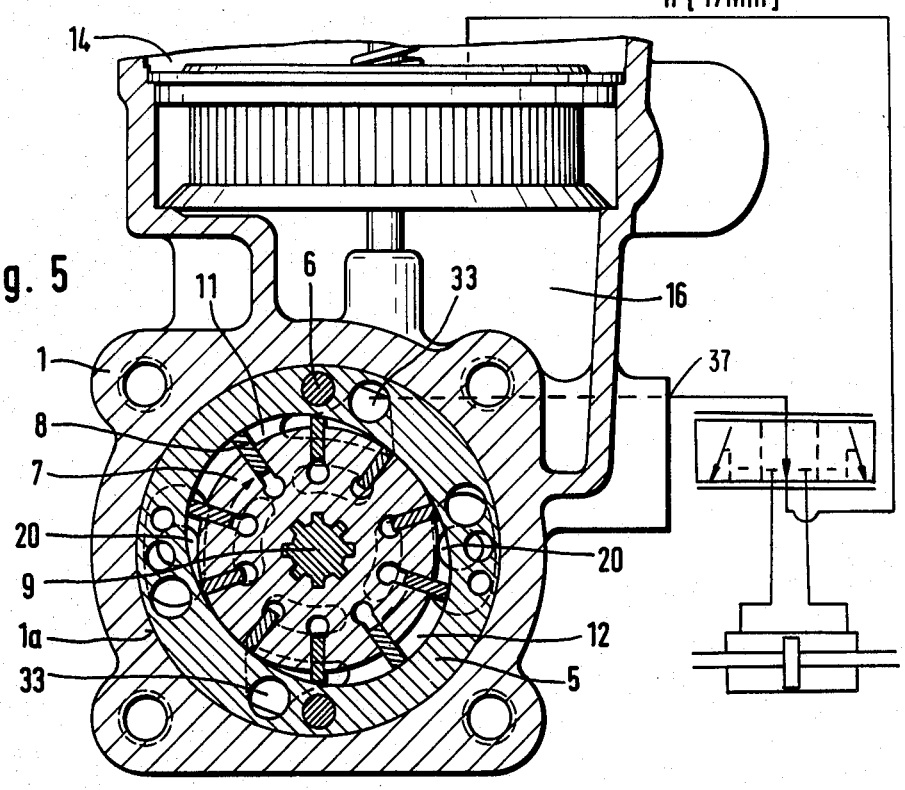
FIG. 5 shows a view in vertical section through the rotary vane pump taken along line V—V in FIG. 1 in a steering system.

Referring now to the drawings and more particularly FIGS. 1, 2 and 5 thereof, shown therein is a pump in the form of a rotary vane pump comprising a main housing portion 1 and a housing cover portion 2 which is secured thereto as by screws, the housing portions 1 and 2 defining a hollow or cavity 1*a* therein, the joint between the housing portions being fluid-tightly sealed in the usual fashion. Disposed in the hollow or cavity 1*a* in the housing defined by the housing portions 1 and 2 are a pressure plate indicated generally at 4 and a cam ring 5 which are both stationary with respect to the housing, being prevented from rotating therein by pin members indicated at 6. Disposed within the cam ring 5 and between the housing cover portion 2 and the pressure plate 4 is a rotor 7 which, as can be clearly seen from FIG. 5, has an array of radial guide slots distributed around the periphery thereof. Vanes 8 are radially displaceably mounted within the respective guide slots.

The rotor 7 is connected by suitable means to a drive shaft 9 for driving the rotor 7 in rotation, with the shaft 9 being mounted in a mounting bore in the housing cover portion 2. The rotor 7 is of a cylindrical configuration while the cam ring 5 has an internal configuration which is approximately oval, as can be best seen from FIG. 5. The minor axis of the oval defined by the internal surface of the cam ring 5 approximately corresponds to the diameter of the rotor while the major axis of the oval determines the distance by which the vanes 8 can extend from their respective guide slots in the rotor 7. In that way, defined between the internal surface of the cam ring 5 and the outside surface of the rotor 7 are two generally sickle-shaped displacement regions 11 and 12 which are subdivided by the vanes 8 into a plurality of cell spaces. At the suction side of the system defined by the above-described components, the cell spaces increase in size while at the pressure side, they decrease in size.

Figure 3:
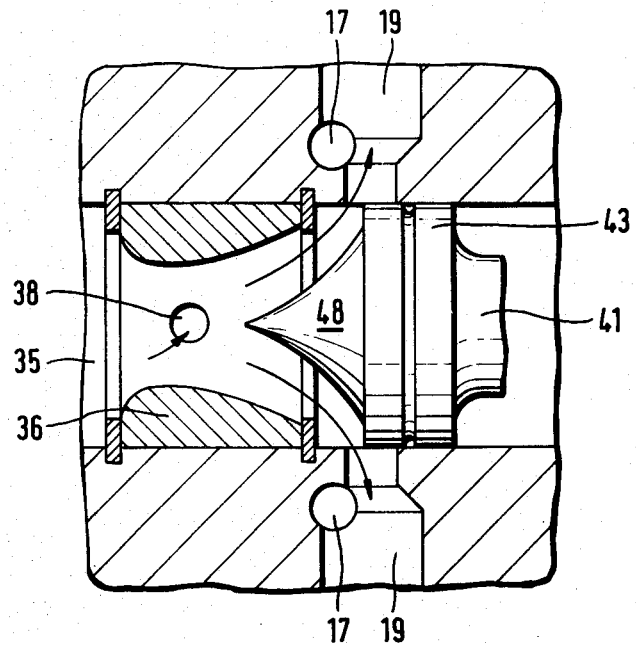
FIG. 3 shows a detail from the pump construction shown in FIG. 2, on an enlarged scale.

As shown in FIG. 5, the supply of hydraulic fluid to the pump is from a tank 14 by way of a distributor or manifold portion 16, by way of two substantially perpendicular bores 17 which are best seen from FIGS. 2 and 3, elbow-bent supply passage portions 18 as shown in FIG. 2, and inlet openings 20 opening into the respective displacement regions 11 and 12 of the pump. The supply passage portions 18 shown in FIG. 2 each include a passage part which extends radially with respect to the longitudinal central axis of the pump as indicated by the dash-dotted line in FIGS. 1 and 2, and which opens into a dump or by-pass passage 19 shown once again in FIGS. 2 and 3.

The discharge of hydraulic fluid from the pump takes place by way of outlet openings shown at 33 in FIG. 1, through the pressure plate 4 to the rear side thereof into a pressure chamber which is indicated generally at 35 in for example FIGS. 1 and 3, from which the discharge flow goes into a throat in the form of a venturi throat 36. In the venturi throat 36, the pump delivery or displacement flow is divided into a controlled output flow, going to the outer pump outlet 37, and an excess flow portion which is controlled by a flow control valve 40, which goes into the passages 19, as can be seen from FIG. 3. The controlled output flow passes through an orifice 38 into a discharge passage 39 which is best seen in FIG. 1 and which also communicates with the control chamber 47 defined in the housing of the valve 40. In the housing the valve 40 has a bore which extends in the axial direction of the pump, that is to say, along the dash-dotted line shown for example in FIG. 1, and in which a spool 41 is axially displaceably disposed. The valve 40 further includes a spring shown as a coil spring 42 which urges the spool 41 towards the venturi throat 36 where it can possibly come into abutment with suitable seating means thereat, to close off the passages 19 in relation to the flow of fluid through the venturi throat 36. The spool 41 has first and second surfaces 53 and 54 (FIG. 1) which are subjected to the pressure of pressure fluid, and two collar-like sealing portions or lands indicated at 43 and 44 in FIG. 1, defining therebetween an annular groove 45. When the valve 40 is in the closed condition, the passages 19 communicate with the annular groove 45, this being the position shown in FIG. 2.

A passage 46 which extends partly radially and partly axially goes from the annular groove 45 through the body of the spool 41 to the control chamber 47, thereby forming a communication between the annular groove 45 and the control chamber 47. The passage 46 is governed by a valve such as a ball valve which responds when a given admissible pressure in the control chamber 47 is exceeded, and discharges that chamber so that the spool 41 acts as a controlled pressure limiting valve, in known fashion. Whether acting as a flow control valve or as a pressure limiting valve, when it responds the valve 40 occupies the position shown in FIG. 3. It should be noted in this respect that, in order to provide for better guidance for the flow of fluid thereby to deflect it more smoothly into the passages 19, it may be advantageous, as illustrated, for the end of the valve spool 41 which is towards the venturi throat 36 to carry a projection portion 48 which is shown in the form of a tapered or conical projection extending into the venturi throat 36.

Figure 4:
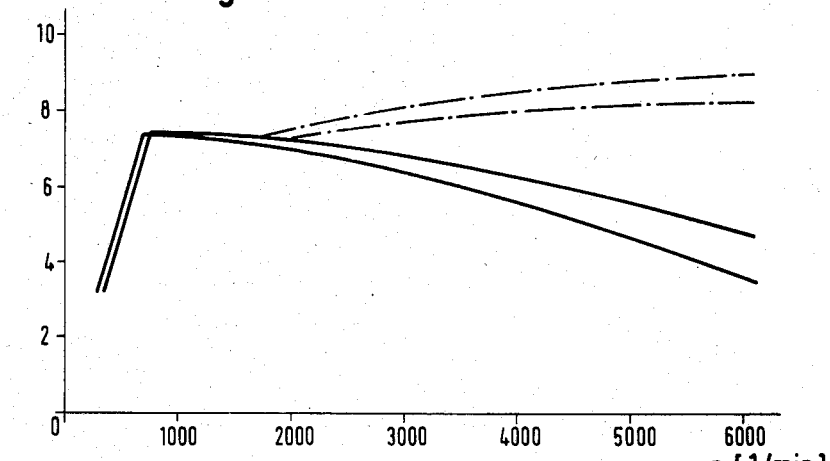
FIG. 4 shows a graph of the output flow in relation to the speed of pump rotation.

The above-mentioned orifice 38 is disposed in the walls of the venturi throat 36 at the narrowest location thereof, or at least closely adjacent thereto. The orifice 38 is in the form of a bore which, in the illustrated embodiment, meets the axis of the venturi throat 36 at least substantially normal thereto. The angle $\alpha$ as defined between the axis of the venturi throat (being coincident with the dash-dotted line shown in FIGS. 1 and 2 which is therefore also the axis of the valve 40) and the axis of the throttle means 38 may be varied according to the respectively desired control characteristic. If a falling characteristic as shown in FIG. 4 is required, the angle $\alpha$ may fall within the range of from 90° to 150°. The characteristic falls away more sharply, with an increasing value in respect of the angle $\alpha$.

The venturi throat 36 may be of a rotationally symmetrical configuration about the axis thereof, but it is also possible to select a form which, as far as possible, does not involve any dead spaces in regard to the flow of fluid therethrough, that is to say, the venturi throat may be flattened off into the plane of the passages 19. As indicated above, the axes of the venturi throat 36 and the valve 40 are aligned with each other. In order to provide a good discharge flow configuration, the venturi throat, at its outlet, should be of a width which at least substantially corresponds to the diameter of the spool 41 at that location. That can be achieved by the venturi throat and the spool 41 being disposed in the same bore, which in this case also defines the control chamber 47 of the valve 40.

The mode of operation of the above-described pump is as follows:

The rotor 7 is driven by means of the rotary shaft 9 and the vanes 8 pass through the displacement regions 11 and 12 so that fluid is supplied to the outer pump outlet 37 by way of the fluid outlet or discharge system 33, 35, 36, 38 and 39, while fluid is drawn into the pump by way of the outer fluid inlet port 16 and the fluid supply system 17, 18 and 20. When the flow of fluid through the orifice 38 exceeds the desired or set value, the pressure drop at the throttle means 38 is sufficiently great to overcome the force of the valve spring 42 biasing the spool 41 towards the closed position thereof, that is to say, the pressure force applied to the surface 53 of the spool is greater than the pressure force applied to the surface 54 of the spool, plus the force applied by the spring 42. A part of the displaced flow of the pump is now taken off by way of the above-described by-pass arrangement, as shown in FIG. 3, while the output flow continues to be taken off by way of the orifice means 38. As shown in FIG. 5, the rotary vane pump may be used with a steering system including an actuator A and directional valve B.

Reference will now be made to FIG. 4 showing a diagram of the controlled output flow with respect to the speed of pump rotation, wherein the dash-dotted lines denote the control performance of the pump without a venturi throat 36 while the solid lines denote the control performance for a pump with the venturi throat 36. At higher pressure of up to 150 bars for example, higher values are generally assumed within the respective ranges indicated by the various lines. When the pump starts up, the delivery flow thereof first increases linearly until the response value of the valve 40 is reached, at for example 750 liters per minute, whereafter the valve 40 causes the major part of the displaced flow to be by-passed in the above-described manner. The controlled output flow, which is the remaining portion of the total displaced flow of the pump, is passed to the steering assistance valve and gives rise to a permanent energy loss.

It will be seen therefore that a pump construction in accordance with the principles of this invention makes it possible more reliably to reduce the controlled output flow with an increasing speed of pump rotation, thereby resulting in an advantageous power ratio.

It will be appreciated that the above-described pump has been set forth only by way of example of the principles of the present invention, and that various alterations and modifications may be made therein without thereby departing from the spirit and scope of the present invention.

What is claimed is:

1. A pump comprising:

a casing having a hollow therein;

a fluid supply system including in said casing an inlet port and inlet opening means communicating with said hollow;

a fluid discharge system including outlet opening means from said hollow and an outlet port in said casing;

fluid displacement means arranged in said hollow and adapted to displace fluid from said supply system into said discharge system to form a flow of displaced fluid;

a flow control valve arranged between said fluid supply system and said fluid discharge system and adapted to by-pass fluid from said discharge system into said supply system so as to leave a desired flow within said discharge system between said flow control valve and said outlet port, said flow control valve comprising a housing means having passage means including an orifice, a spool having a pressure area to open said by-pass and a pressure area to close said by-pass, and a valve spring biasing said spool in a direction to close said by-pass;

said orifice having an upstream and a downstream side, and said upstream side being connected to said by-pass-opening pressure area and said downstream side being connected to said by-pass-closing pressure area; and a venturi throat included in said fluid discharge system and having walls so as to receive all said displaced flow, said orifice being formed as a transverse opening in said walls of said venturi throat and said orifice conducting said desired flow to said outlet port, said venturi throat being disposed substantially coaxially with respect to said spool and being of a width at its downstream end which is substantially equal to the diameter of the spool.

2. A pump as set forth in claim 1 wherein said spool has a projection portion which extends into said venturi throat and to which the regulated pump delivery flow flows.

3. A pump as set forth in claim 1 wherein said venturi throat is of a rotationally symmetrical configuration.

4. A pump as set forth in claim 1 wherein said desired flow, as a portion of said displaced flow, is entering into said venturi throat along its axis and leaving said venturi throat in a bent flow through said transverse opening, said bent flow turning around an angle in a region between 90° and 150°.

5. A hydraulic rotary pump as set forth in claim 1 including a steering system having a first fluid line extending between the outlet port of said pump to the inlet of the steering system and a second fluid line extending between the inlet port of said pump and the outlet of said steering system.

6. In a hydraulic pump assembly comprising: a casing defining a cavity therein; a rotor rotatable in the cavity and defining at least one fluid displacement region therein; a fluid inlet opening and a fluid outlet opening communicating with said at least one displacement region; a hydraulic fluid supply system connecting said fluid displacement region to said inlet opening; a hydraulic fluid discharge system connecting said fluid displacement region to said outlet opening; and a flow control valve operable to communicate the fluid discharge system and the fluid supply system with each other, by the flow control valve by-passing a regulated flow of fluid from the discharge system into the fluid supply system, and directing an outlet flow to said outlet opening, the flow control valve including a housing means having a bore therein, a spool having first and second fluid-engagement surfaces, movable in the bore, spring means acting on the spool urging same towards the position of the valve closing the by-pass, and a restrictor throttle means having an inlet end and an outlet end for said outlet flow, said inlet end being connected to said first surface of said spool, so as to apply pressure at said inlet end to said first surface of said spool, and said outlet end being connected to said second surface so as to apply pressure at said outlet end to said second surface of said spool, the improvement that a throat means in the form of a venturi is disposed upstream of the restrictor throttle means and carries the entire delivery flow of the pump, and the restrictor throttle means branches from said venturi throat means in the form of an opening extending transversely with respect to the axis of the venturi throat means, whereby fluid pressure in the venturi throat means is applied to said first spool surface to urge the spool towards the by-pass-opening position and fluid pressure at the downstream side of said restrictor throttle means is applied to said second spool surface to urge the spool towards the by-pass-closing position, said venturi throat means being disposed substantially coaxially with respect to said spool and being of a width at its downstream end which is substantially equal to the diameter of the spool.

7. A pump assembly as set forth in claim 6 wherein said flow is entering into said venturi throat along its axis and leaving said venturi throat in a bent flow through said transverse opening, said bent flow turning around an angle in a region between 90° and 150°.

* * * * *